US006272758B1

(12) United States Patent
Wheeler

(10) Patent No.: US 6,272,758 B1
(45) Date of Patent: Aug. 14, 2001

(54) STEEL WORKER'S LAYOUT TOOL

(76) Inventor: Gene R. Wheeler, 3835 Bridgton Pl., Magna, UT (US) 84044

( * ) Notice: Subject to any disclaimer, the term of this patent is extended or adjusted under 35 U.S.C. 154(b) by 0 days.

(21) Appl. No.: 09/361,437

(22) Filed: Jul. 26, 1999

(51) Int. Cl.[7] ..... B43L 7/027
(52) U.S. Cl. ..... 33/1 G; 33/481; 33/474
(58) Field of Search ..... 33/1 G, 563, 21.1, 33/21.3, 429, 451, 452, 464, 474, 475, 476, 481

(56) References Cited

U.S. PATENT DOCUMENTS

| | | | | |
|---|---|---|---|---|
| 368,995 | * | 8/1887 | Dailey et al. | 33/464 |
| 826,759 | * | 7/1906 | Branch | 33/464 |
| 1,048,333 | * | 12/1912 | Mishler | 33/482 |
| 1,125,010 | * | 1/1915 | Doner | 33/481 |
| 1,142,418 | * | 6/1915 | Hamalainen | 33/451 |
| 2,026,274 | | 12/1935 | Doyle | 33/429 |
| 2,213,148 | * | 8/1940 | Pyle | 33/451 |
| 3,169,320 | | 2/1965 | Currie | 33/563 |
| 3,239,936 | * | 3/1966 | Hesse | 33/464 |
| 3,427,722 | * | 2/1969 | Ingram | 33/452 |
| 3,939,564 | * | 2/1976 | Slawinski | 33/452 |
| 4,228,594 | | 10/1980 | Shlager | 33/429 |
| 4,352,247 | * | 10/1982 | Rohde | 33/464 |
| 4,499,666 | * | 2/1985 | Smith | 33/476 |
| 5,070,562 | * | 12/1991 | Lentino | 33/481 |
| 5,396,710 | | 3/1995 | Battaglia | 33/429 |
| 5,446,969 | * | 9/1995 | Terenzoni | 33/451 |
| 5,456,015 | * | 10/1995 | Butcher et al. | 33/474 |

* cited by examiner

*Primary Examiner*—G. Bradley Bennett
(74) *Attorney, Agent, or Firm*—Kirton & McConkie; Michael F. Krieger

(57) ABSTRACT

The present invention is a steelworker's layout tool for use in laying out the bolt and weld patterns used to connect steel structural members and in fitting up these members. Preferred embodiments of the present invention comprise parallel arms which are spaced apart at distances which correspond to standard bolt spacing distances and which can be used to measure around the protruding flanges on steel members with channel shapes, I shapes or other cross-sectional variations.

20 Claims, 9 Drawing Sheets

STEEL WORKER'S LAYOUT TOOL

FIELD OF THE INVENTION

The present invention relates generally to the field of hand tools for construction workers and more specifically to hand tools used by steelworkers and steel fabricators to lay out bolt and weld patterns and to fit up structural steel members.

BACKGROUND

Structural steel members are widely used in the construction of buildings, bridges, billboards, signs, piers, foundations, retaining walls and similar structures. These structures are typically built with a steel fine to which floors, walls, panels and other elements are connected. These steel frames are typically constructed from structural steel members which are made with standard cross-sectional shapes which are especially suited for particular applications.

One cross-sectional shape that is particularly common is the ubiquitous "I-beam." The "I" shaped cross-section of the I-beam has a particularly high moment of inertia for its size and weight making it extremely useful as a beam for carrying loads. This shape also makes it resistant to buckling when used as a column or brace. Several variations of the I-beam have become standard in the industry and are shown in FIG. 1. The "W" shapes or wide-flange sections 2, the "M" shapes or miscellaneous flange sections 4, the "S" shapes or standard flange sections 6 and the "HP" shapes or bearing pile sections 8 all have the characteristic "I" shape with its protruding flanges 16 and interior web 18. Structural channels 10 and angles 9 also have a shape with protruding flanges 16, however, on channel sections 10 and angles 9 the flanges protrude from only one side of the web. Structural "T " shapes 12 also have protruding flanges as do numerous other composite shapes 14 which may be fabricated for special purposes.

Connections between structural steel members are typically made using multiple bolts which are spaced apart in specific patterns with precise spacing dimensions or using welds along with gussets and brackets to form the connection. Connections of structural steel members may be simple connections, as shown in FIGS. 2A through 2D where shear forces are transferred, but little bending moment is transferred in the connection or they may be more complicated moment resisting connections, as shown in FIGS. 2E and 2F where substantial bending moment and shear forces are transferred in the connection. Both types of connections typically require numerous bolts 20 arranged in patterns 22 with standard spacing requirements.

The fabrication of these bolted connections begins in the shop where beams, columns and other members are cut, welded, drilled and otherwise prepared for assembly on a construction site. Often clips, gussets, brackets, stiffeners, plates and other elements are cut and welded or bolted to one member and drilled for assembly to an accompanying member with bolts which are inserted on site. This construction fabrication requires precise measurement of bolt and other element locations so that field assembly will flow smoothly without interruption. Accordingly, bolt and weld locations must be laid out with precision, accuracy and efficiency.

While bolt locations and patterns vary for different connections, grades of steel and member shapes, the prevalence of certain grades of steel and certain structural shapes makes some bolt spacing patterns especially common. Bolt spacings which are commonly found in structural steel connections are 3" and 5½" . In laying out these patterns, measurements must often be made from the top of the top flange on the beam to a point on the beam web. This requires a steelworker to measure around the top flange and place an accurate mark on the web of the steel member. This requires several steps and multiple tools using conventional layout tools. A tool which allows this measurement to be performed in one step can drastically increase productivity and significantly reduce the possibility of error.

Large structural steel members can be extremely expensive and an incorrectly placed bolt pattern can damage or completely ruin one of these members causing extensive financial loss. Furthermore, a mistake may not be discovered until the steel member is raised to the top of a high-rise building project with a crane. At this point many man-hours may have been wasted in transporting and placing the steel member only to discover that the member is defectively fabricated. This type of mistake can be extremely costly in wasted man-hours and material. Consequently, steelworkers are typically highly skilled workers who gain extensive experience before receiving responsibility for connection layout.

Due to the heightened responsibility and the highly skilled nature of the job, steel workers typically receive higher wages than the majority of construction workers. A steelworker who can work quickly and efficiently is, therefore, a tremendous asset. Correspondingly, a tool which can improve steelworker speed and efficiency and increase accuracy and precision is also a tremendous asset.

SUMMARY AND OBJECTS OF THE INVENTION

Preferred embodiments of the present invention comprise a tool that is especially useful in laying out bolt and weld patterns on flanged structural steel members. The present invention is also useful in measuring and laying out cuts and connections on structural steel tubing, pipe and other non-flanged members.

Preferred embodiments of the present invention comprise a tool with parallel arms which can be used to reach around the flange of a steel member and measure directly to a point on the member's web. The edges of these parallel arms are spaced apart at distances which are commonly used for bolt spacing so that standard pattern measurements can be easily measured without clumsy manipulation of adjustable squares and tapes. The result is a measurement which is not only more accurate, but one that is completed in a fraction of the time required for completion with known tools.

Preferred embodiments of the present invention also comprise an offset design which forms somewhat of a "Z" shape and which allows the invention to be used as a conventional square as well as a special purpose square which can be used on corners with fillet welds, inside radii or other obstructions. The offset design also allows the present invention to be used to mark perpendicular lines on pipes and other round members. Additionally, the offset design's "Z" shape allows the present invention to be self-supporting when placed on its edge so that it may be used for squaring and fitting-up a connection while affording the user a "hands-free" situation.

Preferred embodiments of the present invention also comprise novel extensions which give the present invention a variable length to increase its utility and accuracy for certain measurements. Further, the present invention is made in a variety of sizes to accommodate different ranges of steel member size.

An adjustable, locking cross bar is also incorporated into preferred embodiments of the present invention and allows the present invention to be used directly as a level, to locate the top of a horizontal pipe and other uses.

The present invention allows for the speedy and accurate accomplishment of myriad measurements not previously measurable with any single known tool.

Accordingly, it is an object of preferred embodiments of the present invention to provide a method and apparatus for direct and precise measurement around flanges and other protrusions on steel members.

It is another object of preferred embodiments of the present invention to provide a method and apparatus for making a perpendicular measurement from an inside corner which has a radius or a fillet weld.

It is an additional object of preferred embodiments of the present invention to provide a method and apparatus for locating the top of a horizontal pipe or round object.

A further object of preferred embodiments of the present invention is to provide a method and apparatus for simplifying the layout of standard bolt patterns.

An additional object of preferred embodiments of the present invention is to increase steelworker efficiency, accuracy and productivity.

A once further object of preferred embodiments of the present invention is to provide a tool for measurement of right angles that is self-supporting on its edge.

BRIEF DESCRIPTION OF THE DRAWINGS

In order that the manner in which the above-recited and other advantages and objects of the invention are obtained, a more particular description of the invention briefly depicted above will be rendered by reference to a specific embodiment thereof which is illustrated in the appended drawings. With the understanding that these drawings depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The figures listed above are expressly incorporated as part of this detailed description.

It will be readily understood that the components of the present invention, as generally described and illustrated in the figures herein, could be arranged and designed in a wide variety of different configurations. Thus, the following more detailed description of the embodiments of the system and apparatus of the present invention, as represented in FIGS. 1 through 9B, is not intended to limit the scope of the invention, as claimed, but it is merely representative of the presently preferred embodiments of the invention.

The presently preferred embodiments of the present invention will be best understood by reference to the drawings, wherein like parts are designated by like numerals throughout.

Figure 1A:
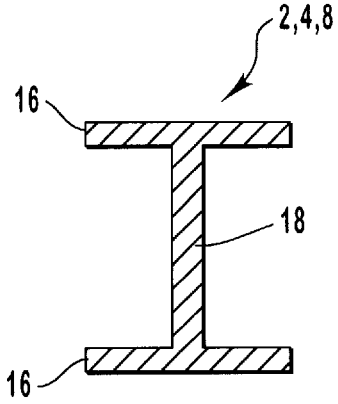
FIG. 1 shows cross-sectional views of common structural steel members.
Figure 1B:
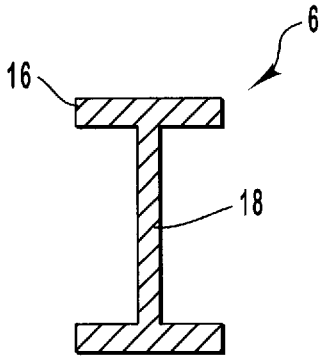
Figure 1C:
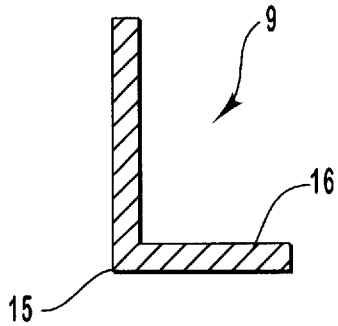
Figure 1D:
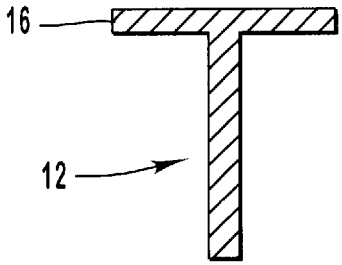
Figure 1E:
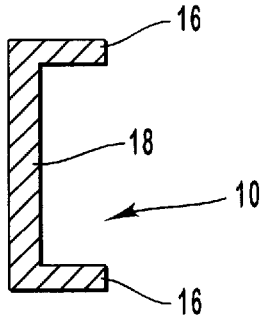
Figure 1F:
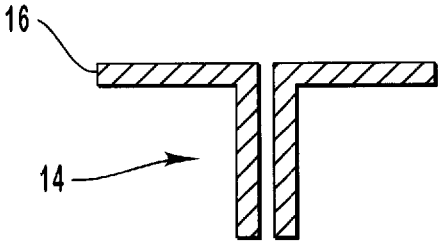
Figure 1G:
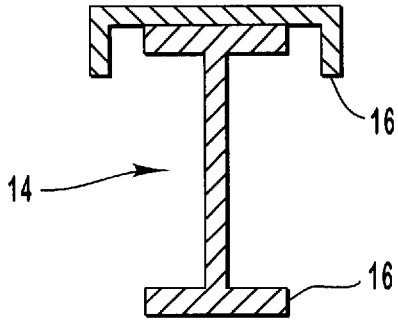
Figure 2A:
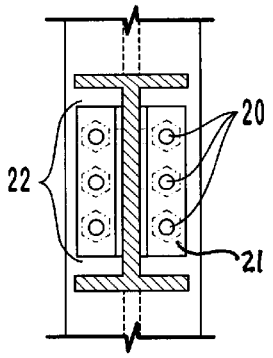
FIG. 2A shows a sectional view of a simple structural steel connection with web clips only.
Figure 2B:
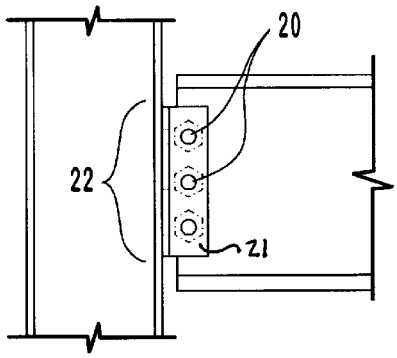
FIG. 2B shows a side view of a simple structural steel connection with web clips only.
Figure 2C:
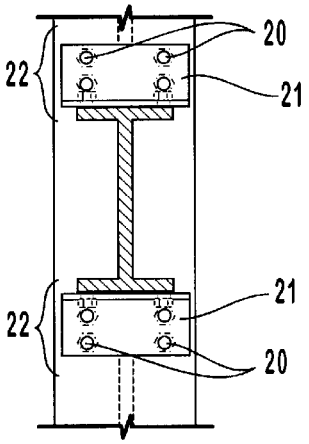
FIG. 2C shows a sectional view of a simple structural steel connection with flange clips only.
Figure 2D:
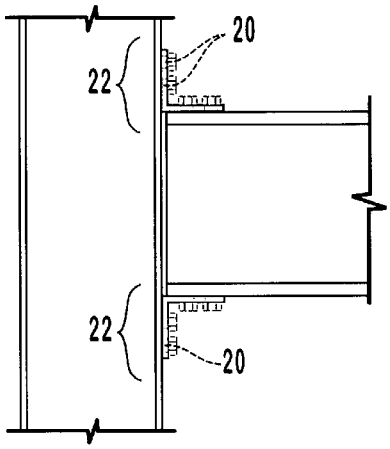
FIG. 2D shows a side view of a simple structural steel connection with flange clips only.
Figure 2E:
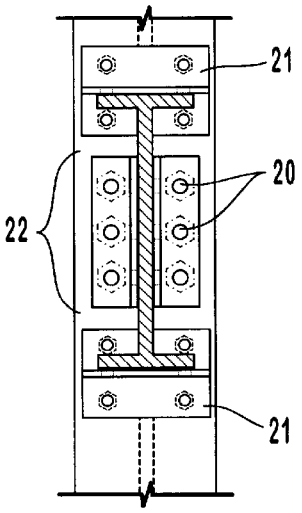
FIG. 2E shows a sectional view of a moment-resisting structural steel connection with flange clips and web clips.
Figure 2F:
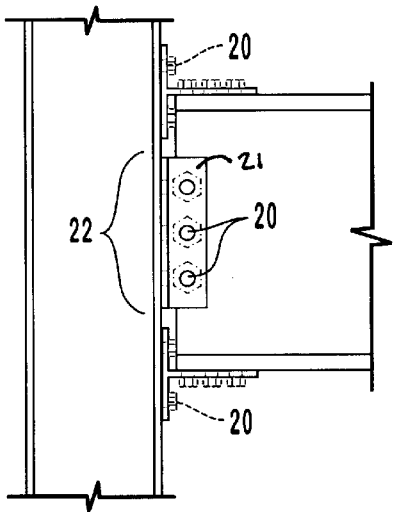
FIG. 2F shows a side view of a moment-resisting structural steel connection with flange clips and web clips.
Figure 3:
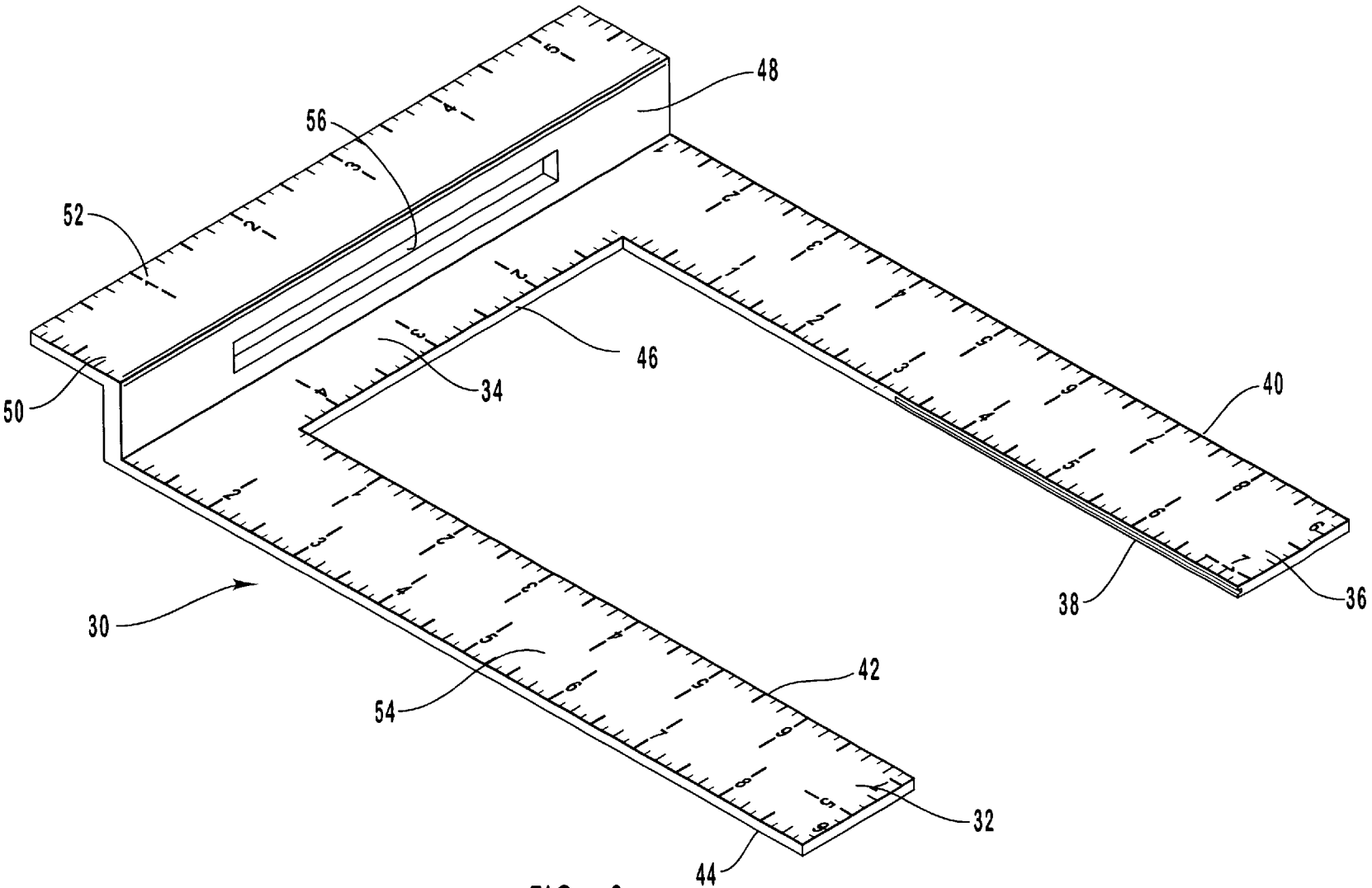
FIG. 3 is a perspective view of a preferred embodiment of the present invention.

In reference to FIG. 3, a currently preferred embodiment of the present invention 30 is shown in perspective view looking down on the top side of the invention. This embodiment of the present invention comprises a right leg 32 which protrudes outwardly from a base plate 34. A left leg 36 also protrudes outwardly from base plate 34. Right leg 32 has an interior edge 42 and an exterior edge 44 and left leg 36 has an interior edge 38 and an exterior edge 40. Base plate 34 also has a working edge 46. In a preferred embodiment of the present invention the interior edges 38, 42 and the exterior edges 40, 44 of legs 32, 36 are perpendicular to working edge 46 and offset member 48 as well as reference edge 60 and are therefore parallel to each other. It should be noted that additional legs and edges may be incorporated into the present invention such as a leg or edge which forms a 45 degree angle or some other common angle to working edge 46.

This preferred embodiment of the present invention further comprises an offset member 48 which extends substantially perpendicularly from base plate 34 and parallel with working edge 46. End member 50 protrudes perpendicularly from offset member 48 in a direction opposite that of legs 32 & 36 such that a top surface 52 of end member 50 forms a substantially planar surface which is substantially parallel with a substantially planar surface formed by the a top surface 54 of base plate 34 and legs 32 & 36.

When the illustrated embodiment of the present invention 30 is placed on a horizontal surface, legs 32 & 36 and end member 50 are substantially horizontal while offset member 48 is substantially vertical.

A rectangular aperture 56 is placed in offset member 48 which aids a user in lifting and handling the present invention especially when gloves are worn. Aperture 56 also acts to lighten the present invention and provide better balance, however embodiments of the present invention may be constructed without aperture 56.

Figure 4A:
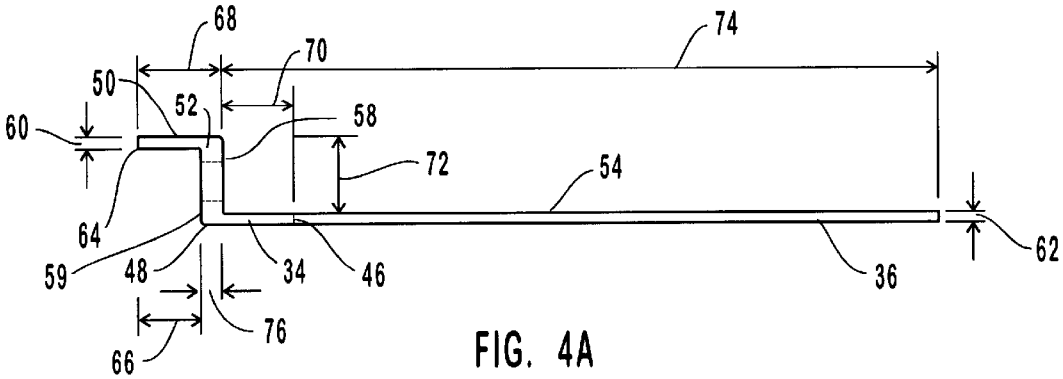
FIG. 4A shows a side view of a preferred embodiment of the present invention.

The geometric relationship between offset member 48, end member 50, base plate 34 and legs 32 & 36 can be seen in FIG. 4A where a side view of a preferred embodiment of the present invention is shown.

The present invention comprises several reference edges and reference surfaces from which measurements and markings can be made. These surfaces and edges may be positioned along the edge of a construction member or they may be used as a guide to mark measurements or lines on a member. Any surface or edge from which a measurement can be made or which may be used to align the present invention with a construction member may be referred to as a reference surface or edge. Surfaces on a preferred embodiment of the present invention which serve as reference surfaces or reference edges include, but are not limited to, reference edge 60, interior surface 58, exterior surface 59, working edge 46, interior edges 38 & 42 and exterior edges 40 & 44.

In a currently preferred embodiment of the present invention, the distance 72 between the top surface 54 of base plate 34 and the top surface 52 of end member 50 is approximately 1 inch and the distance 68 between the interior surface 58 of offset member 48 and the reference edge 60 of end member 50 is approximately one inch. The width 70 of base plate 34 from the interior surface 58 of offset member 48 to working edge 46 is approximately ¾ of an inch. The thickness 62 of legs 32 & 36 and base plate 34 and the thickness 64 of end member 50 is preferably approximately ⅛ of an inch and the thickness 76 of offset member 48 is preferably ¼ of an inch when the present invention is constructed of high-strength metals such as steels, stainless steels, aluminum or others. The present invention may also be constructed of high strength plastics, fiberglass and other materials. When other materials are used, the various thicknesses and dimensions will vary to accommodate the strength and other properties of the material used.

The total base length 74 of base plate 34 and legs 32 & 36 from the interior surface 58 of offset member 48 to the distal edges of legs 32 & 36 will vary for each model of the present invention. In a currently preferred embodiment, several sizes of the present invention are used depending on the size of the structural steel or other members being laid out. In this preferred embodiment, the base length 74 will be 5", 8" or 12" depending on the size selected. Other lengths and dimensions are to be considered within the scope of this invention.

Figure 4B:
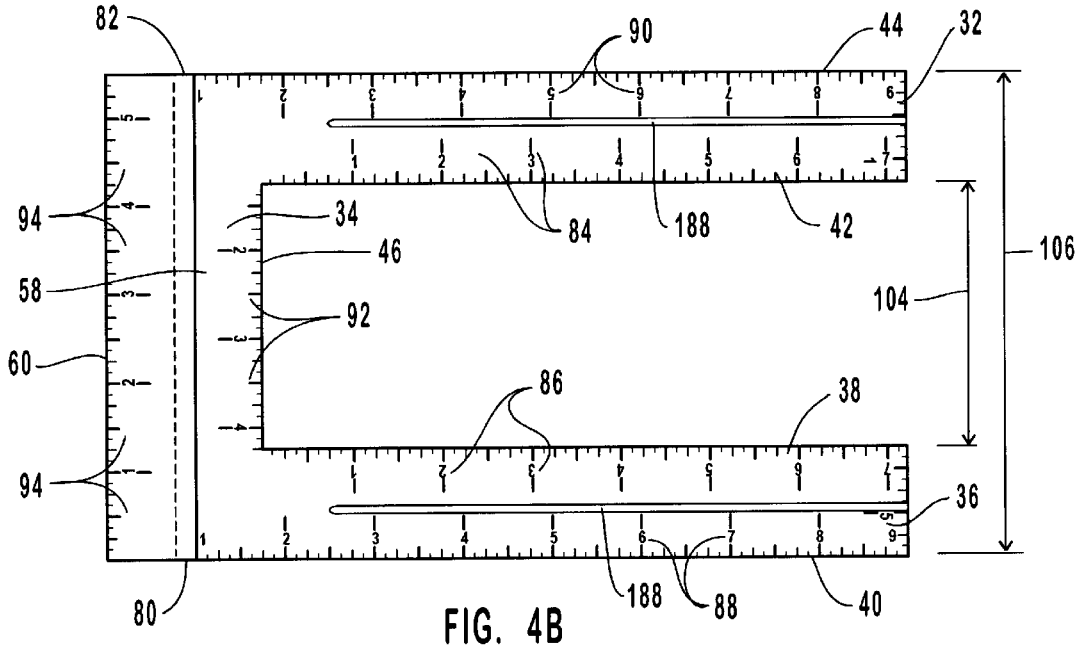
FIG. 4B shows a top view of a preferred embodiment of the present invention.
Figure 4C:
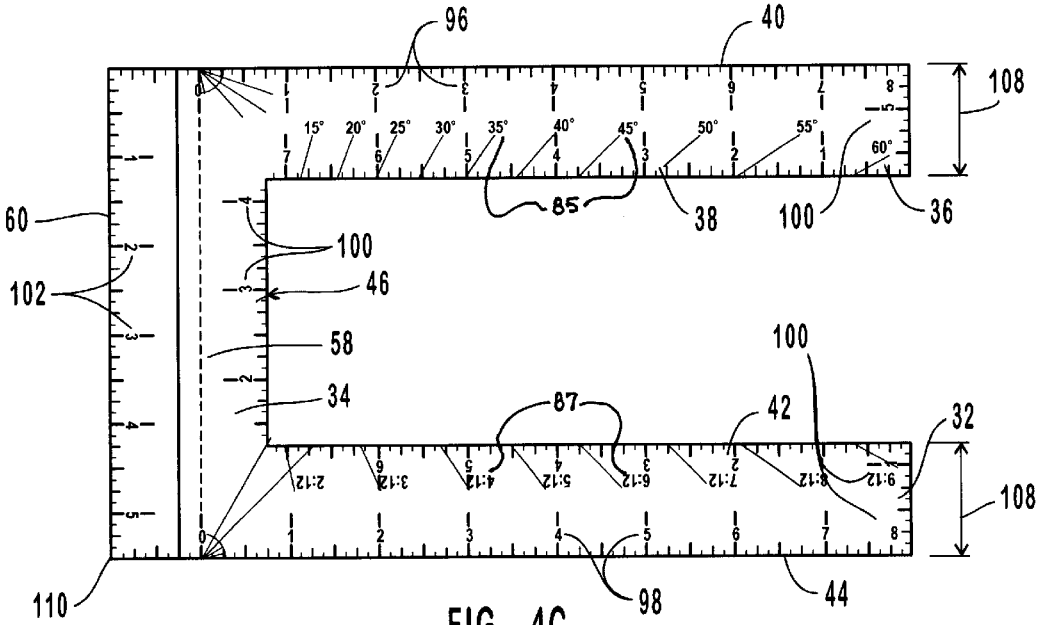
FIG. 4C shows a bottom view of a preferred embodiment of the present invention.

In reference to FIGS. 4B and 4C where a bottom view and a top view of a preferred embodiment of the present invention is shown, the interior edges 38 & 42 of legs 32 & 36 are parallel and spaced at an interval 104 that corresponds to a standard spacing distance for steel connectors as used in the industry. In a currently preferred embodiment this interval 104 is 3 inches. The exterior edges 40 & 44 of legs 32 & 36 are also parallel to each other and perpendicular to the interior surface 58 of offset member 48 so as to form a right angle therewith. Exterior edges 40 & 44 are also spaced apart at an interval 106 which corresponds to a standard spacing distance for connectors such as bolts, rivets and other connectors which are commonly used in the industry. In a currently preferred embodiment, interval 106 is 5½". The dimensions of 3" and 5½" are common bolt spacing distances for structural steel. Other distances may be used for other common bolt spacing intervals for structural steel or for other connectors and other materials. The present invention may be adapted for bolt spacing in wood members, nail spacing in wood members or many other spacing parameters. In a currently preferred embodiment, the width 108 of legs 32 & 36 becomes 1¼" due to the spacing of 3" and 5½" for the interior and exterior surfaces. In other embodiments, legs 32 & 36 may have different widths which may or may not be equal to each other.

The functionality of the present invention is further increased with the ability to make linear measurements. In a preferred embodiment, a top end linear measurement scale 94 is printed, engraved, etched, molded, stamped or otherwise marked on the top face of end member 50 along reference edge 60. This scale extends from left to right when facing it from base plate 34 extending between the edges of end member 50 and may be divided into appropriate fractions of an inch or metric units as needed for a particular trade or system. Numerals and other markings are arranged to be read from the base plate 34 side of end member 50. A bottom end linear measurement scale 102 is located on the opposite face of end member 50 extending between the same edges as scale 94, but with markings oriented to be read from the reference edge 60 side of end member 50.

Further linear scales are located along the legs of preferred embodiments of the present invention. As shown in FIG. 4B, a top left linear scale 90 extends along the exterior edge 44 of the top face of left leg 32. Top left linear scale 90 begins at a reference point located at the intersection of an extension of exterior edge 44 and reference edge 60. A top right linear scale 88 extends along the exterior edge 40 of the top face of right leg 36. This scale begins at a reference point located at the intersection of an extension of exterior edge 40 and reference edge 60 and extends to the distal end of right leg 36.

A top left interior linear scale 84 may also be marked on preferred embodiments of the present invention along the interior edge 42 of the top surface of left leg 32. Top left interior scale 84 has a reference point at the intersection of interior edge 42 and working edge 46 and extends to the distal end of left leg 32. Similarly, a top right interior linear scale 86 may also be marked along interior edge 38 and extends from a reference point at the intersection of interior edge 38 and working edge 46. Both top interior linear scales 84 & 86 have indicia oriented to be read from the side corresponding to the opposite leg of the present invention.

Linear scales are also located on the bottom surfaces of legs 32 & 36 as shown in FIG. 4C. A bottom left reference scale 98 is marked along the exterior edge 44 of the bottom face of left leg 32 and extends from a reference point at the intersection of exterior edge 44 of left leg 32 and interior surface 58 of end member 50 to the distal end of left leg 32. A bottom right reference scale 96 is marked along the exterior edge 40 of the bottom face of right leg 36 and extends from a reference point at the intersection of the exterior edge 40 of right leg 36 and interior surface 58 of end member 50 to the distal end of right leg 36.

Bottom interior linear scales may also be marked along the interior edges 38 & 42 of the bottom faces of legs 32 & 36.

A bottom lateral linear reference scale 100 is found on the bottom face of base plate 34 and the bottom face of legs 32 & 36 along their distal ends and along working edge 46 with markings oriented to read from the leg side of the tool. The markings on this scale 100 reference distances measured from exterior edge 44.

A top lateral reference scale 92 is found on the top face of base plate 34 and the top face of legs 32 & 36 along their distal ends and along working edge 46 with markings oriented to read from the end member 50 side of the tool. The markings on this scale 92 reference distances measured from exterior edge 44.

In addition to linear measurements, preferred embodiments of the present invention may be used to measure and mark angular measurements. Angular scales may be used to measure angles in degrees or in terms of rise over run as is commonly done in the industry for roof slopes and other angles. Other angular units may also be used. Angular scales may be located on the bottom side of the present invention where preferred embodiments may have angular reference points 80 & 82 located at the intersections of exterior edges 40 & 44 and the interior surface 58 of offset member 48. Angular scale markings 85 & 87 may be aligned along the interior edges 38 & 42 of legs 32 & 36 or may be marked elsewhere. Angular scale markings 85 & 87 may be marked for direct marking of angles as with a protractor or may be marked such that alignment with a given mark will orient an edge of the present invention according to the angular designation of that mark.

An advantage of the present invention over the prior art comes from its utility in laying out bolt patterns on structural steel members particularly flanged members. The most common layout distance in typical steel structure bolt patterns is 3 inches, hence the distance between interior edges 38 & 42 is 3 inches. Bolt patterns are typically laid out in reference to the top surface of the beam's top flange, therefore, measurements for bolts on the web must be made around the top flange.

Figure 5A:
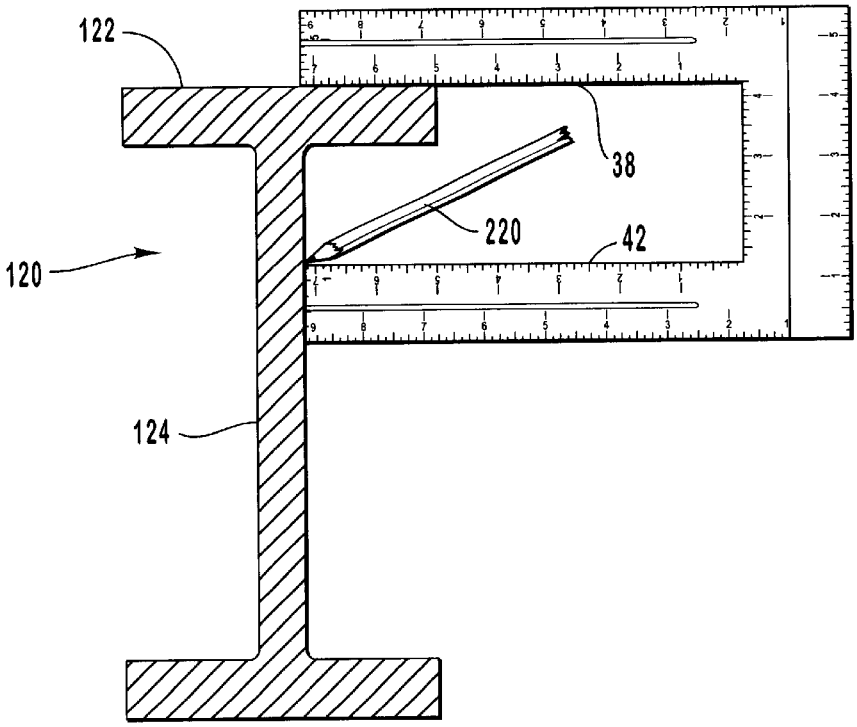
FIGS. 5A–C show how the present invention may be used to measure around the flange on a flanged member and lay out a bolt pattern on the members web.
Figure 5B:
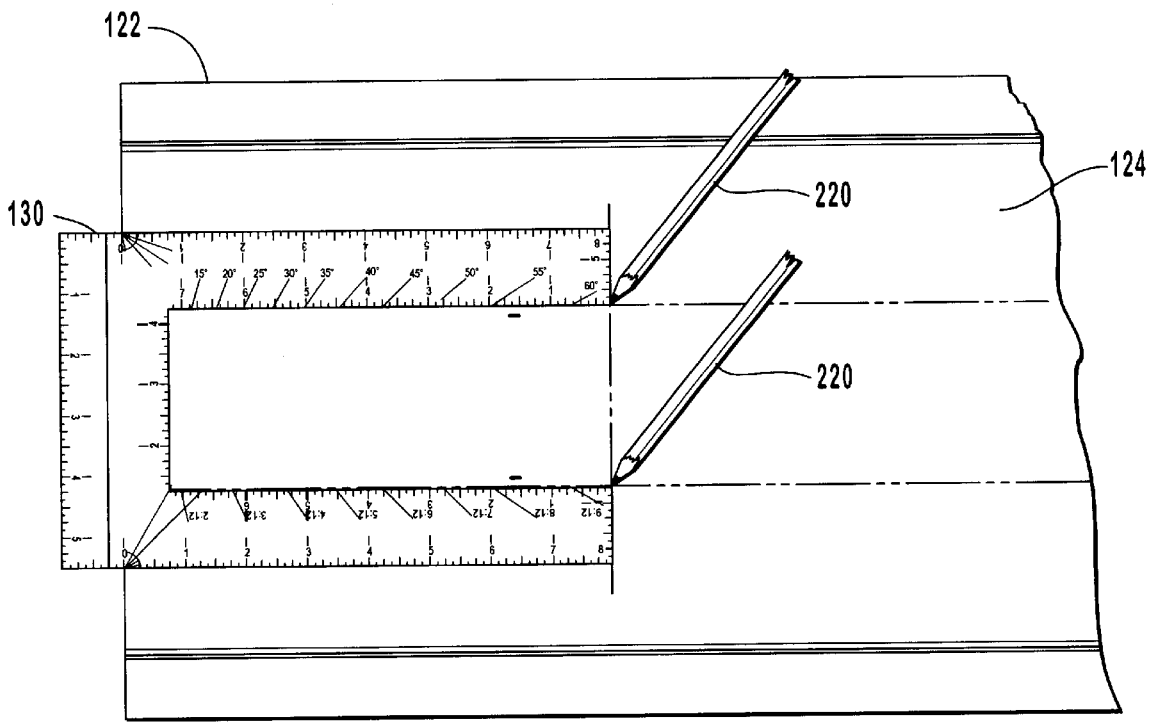

In reference to FIG. 5A, the present invention may be positioned such that one interior edge 38 is aligned with the top surface 122 of flanged beam 120. In this position, the opposite interior edge 42 will intersect with the beam's web at a location exactly 3 inches from the top surface 122. Markings can be made anywhere along the length of the beam using this method and the present invention. Once this first line of reference marks is located, preferred embodiments of the present invention may be relocated to location 130 from where a parallel line can be measured at 3" or 5½" from the first reference line. Accordingly, parallel lines with 3" separation can be quickly laid out.

Figure 5C:
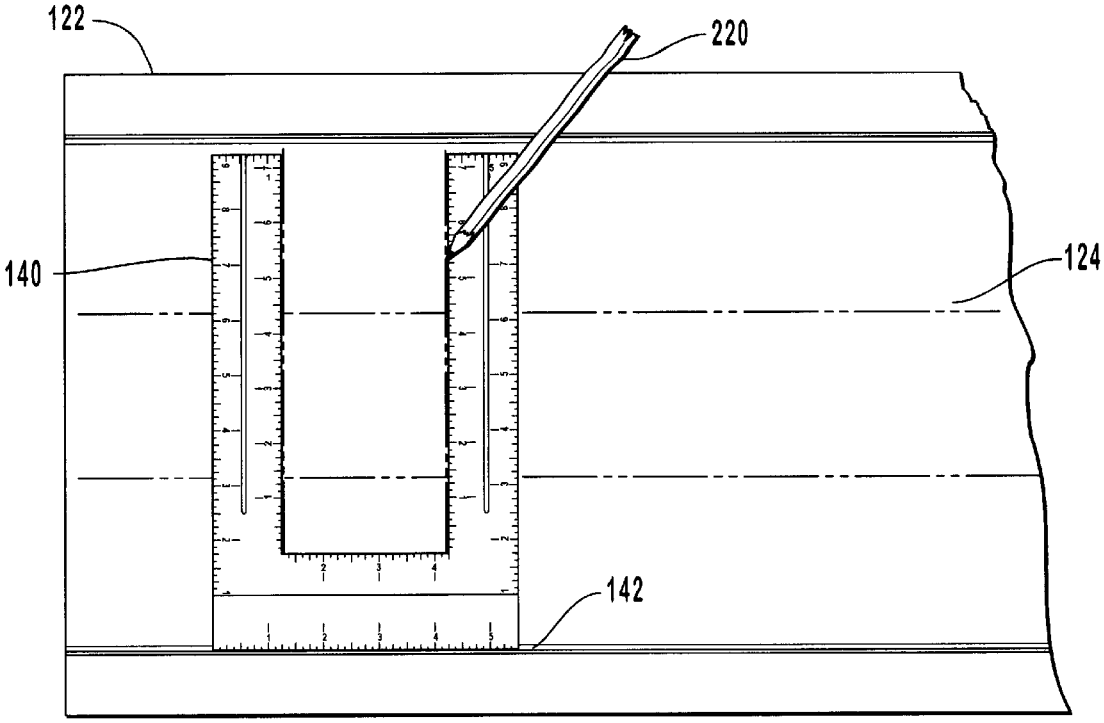

Another quick relocation can align the present invention with the bottom or top flange of the beam such that lines perpendicular thereto may be marked and measured. This may be performed by aligning reference edge 60 with the interior surface of a beam flange as shown in FIG. 5C at 140. Markings may then be quickly laid out at 3 " or 5½" intervals as needed. The offset design of the present invention, with offset member 48 and end member 50 allows the present invention to be used to create accurate perpendicular lines while avoiding inaccuracies related to the inside radius 142. Other spacing intervals may also be laid out using the linear reference scales of the present invention.

The specific 3" and 5½" leg spacing of a preferred embodiment of the present invention is particularly useful in laying out framing clips 21 for structural steel connections. These framing clips 21 shown in FIGS. 2A through 2F are typically constructed from short lengths of angle steel stock. Typically, when two rows of bolts are used, the clip is 5½" in length with rows of bolts spaced 3" apart. These clips are quickly laid out by butting interior surface 58 and top face 54 against the outside comer 15 of a length of angle stock and by aligning exterior edge 44 with the end of the angle stock. Marks may then be quickly placed at 5½" for the end of the clip and bolt marking may be made at a spacing of 3" centered on the clip. The lateral location of the bolts may be measured using the linear scales on the legs of the present invention. This embodiment of the present invention may then be relocated at the 5½" mark and another clip can be quickly marked within seconds. This specialized tool and its particular dimensions help to increase the speed and accuracy of this process.

Figure 6:
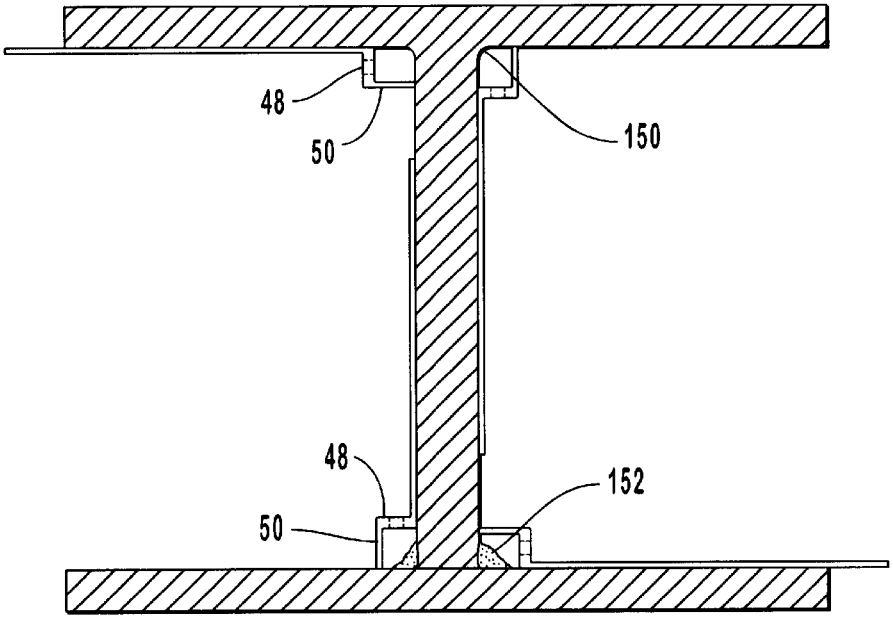
FIG. 6 shows how the offset design of the present invention avoids inside radii and fillet welds.

The offset design of the present invention may be used to align markings with members which have inside radii or fillet welds. As shown in FIG. 6, offset member 48 and end member 50 allow the present invention to be laid flat on a first beam surface while aligning reference edge 60 with a perpendicular surface which is joined to the first beam surface with a radius 150 or fillet weld 152. This offset design allows accurate measurement and marking despite irregularities in the joint.

Figure 7A:
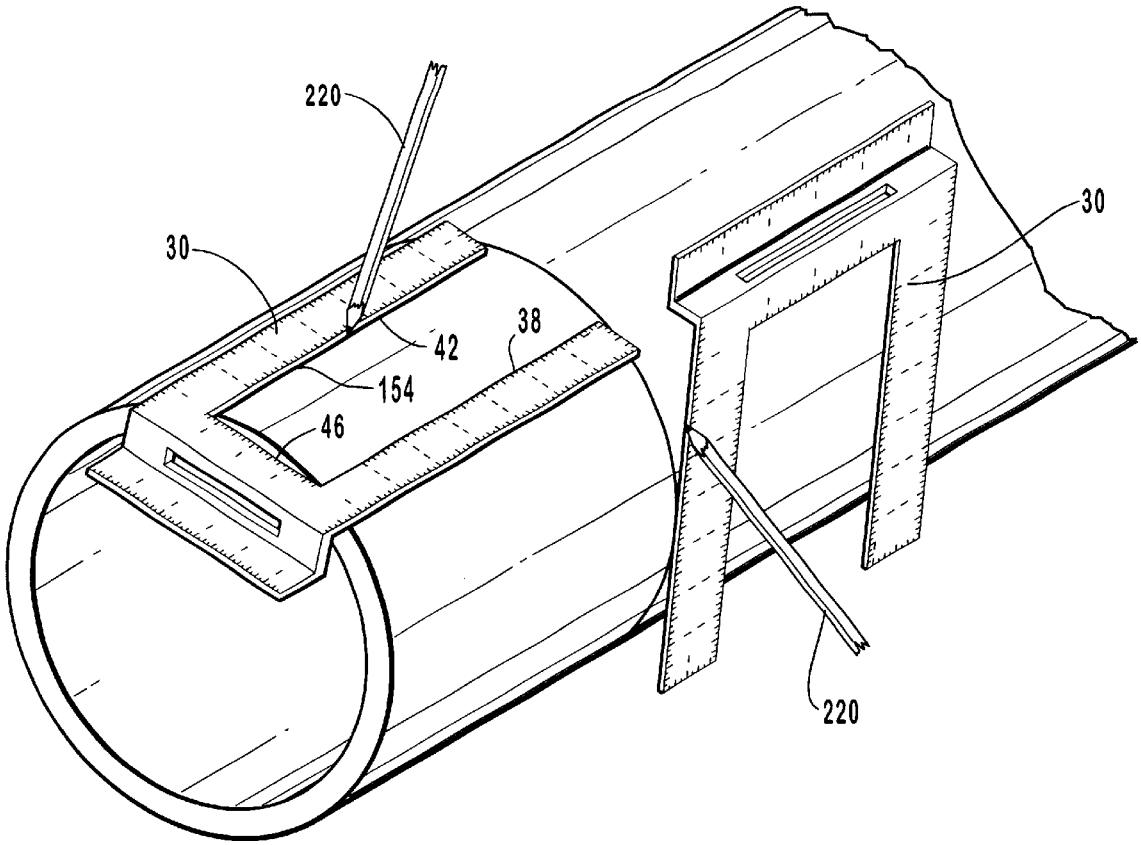
FIG. 7A shows an embodiment of the present invention as it is used to mark a perpendicular circumference around a pipe as well as a longitudinal line along the pipe.

Alternative uses of the present invention include marking lines around the circumference of a pipe or round element as shown in FIG. 7A. The orientation of the edges of the present invention allows it to be used to make a partial circumferential line around a pipe or other object with a circular cross-section. Once the partial line is marked, the present invention is moved to a new location which is in alignment with the partial line and the line may thereby be extended until it forms a complete circumference.

Working edge 46 may also be aligned with a butt end of a member while inside edges 38 & 42 align with the member's longitudinal axis thereby allowing the present invention to be used to mark a longitudinal line on the member 154.

Figure 7B:
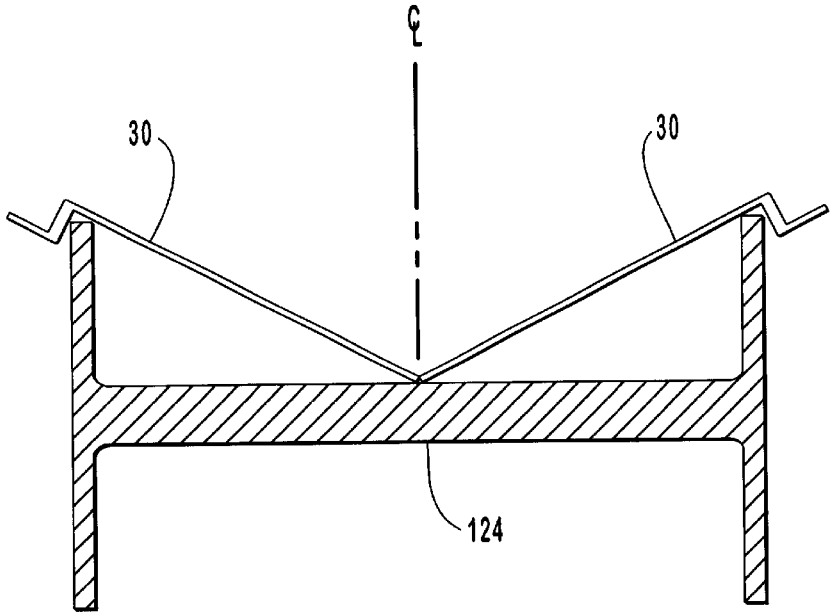
FIG. 7B shows how an embodiment of the present invention may be used to find the centerline of a beam's web.

Embodiments of the present invention may also be used to find the centerline of a beam's web as shown in FIG. 7B. Offset member 48 is aligned with the flanges of the beam while legs 32 & 36 rest on the web. Two tools may be used or the user may make a mark where the distal end of the legs touch the beams'web and the tool may then be reversed and aligned with the opposite flange to make a similar mark. The center of the beam will be located at the midpoint between the two marks.

Figure 8A:
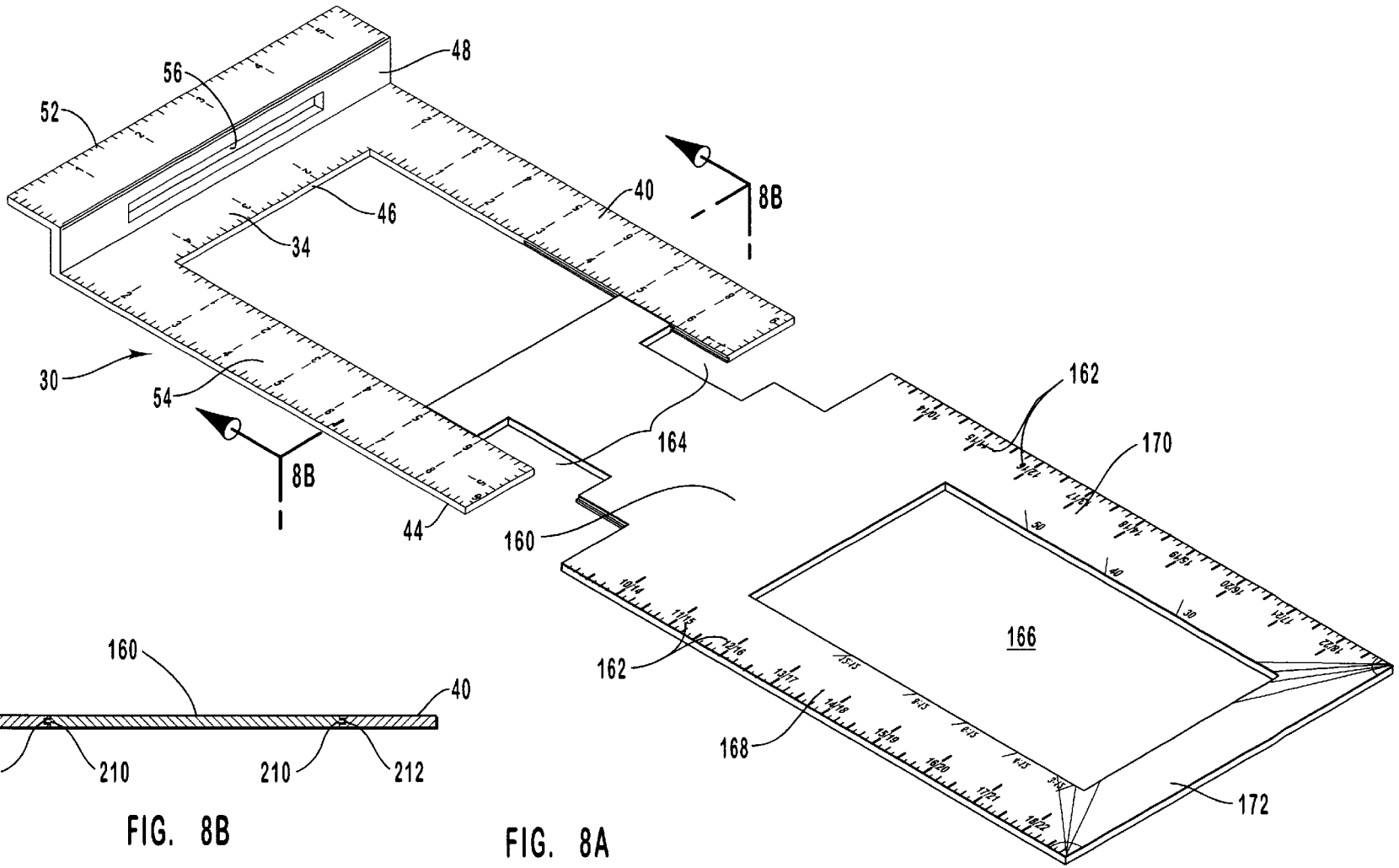
FIG. 8A is a perspective view of an extension plate of a preferred embodiment of the present invention.

Structural members, plates and other materials can often exceed the dimensions of some embodiments of the present invention. Embodiments of the present invention may be increased in size to accommodate these materials, however the increased bulk and size may make such embodiments unwieldy, heavy and cumbersome especially when used with smaller members. Accordingly, preferred embodiments of the present invention comprise an extension plate 160 as shown in FIG. 8A. Extension plate 160 may connect to legs 32 & 36 and effectively extend the length of the present invention to any practical distance. Preferred embodiments of extension plate 160 extend the length of the present invention by 8" or 12".

Figure 8B:
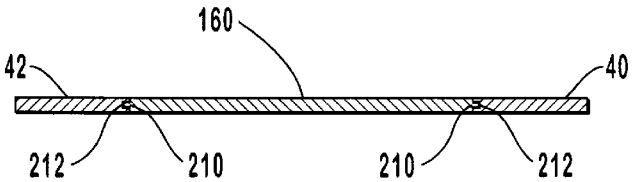
FIG. 8B shows a cross-sectional view of a preferred engagement between the extension plate and the legs of an embodiment of the present invention.

A preferred embodiment of extension plate 160 connects to the legs 32 & 36 of the present invention along interior edges 38 & 42. A tongue 210 and groove 212 fit along interior edges 38 & 42, as shown in FIG. 8B, may be used for the connection. A V-groove or other cross-sectional shape will also perform satisfactorily so long as extension plate 160 is held in alignment with legs 32 & 36. An interference fit or friction fit may operate to secure this connection, however spring-loaded pins or clips or other known releasable locking devices will also perform well. Alternatively, extension plate 160 may fit between the interior edges 38 & 42 with a close tolerance fit, but with no interlocking mechanism so that it may be easily slid into position and quickly removed.

The linear measurement and angular measurement scales located on the legs 32 & 36 of the present invention may be extended onto extension plate 160 to further increase its utility. Furthermore, additional angular and linear measurement scales may be marked on extension plate 160. Because extension plate 160 can be used with different size models of the present invention, its linear scales must extend from different reference points. Therefore, extension plate 160 may comprise multiple markings 162 along some of its linear reference scales to accommodate legs of different standard lengths.

Portions of extension plate 160 may be omitted, removed, machined or drilled out to lighten the apparatus, provide marking points or reference points, to balance the apparatus or to decrease material content or cost. Voids in extension plate 160 may be located so as to provide access to the material below for marking purposes as do voids 164. Large void 166 is located and shaped so as to extend interior edges 38 & 42 and their common 3" spacing interval thereby forming a rectangular shape. Large void 166 may have an open end with separate legs 168 & 170 or it may be closed with an end piece 172.

Figure 9A:
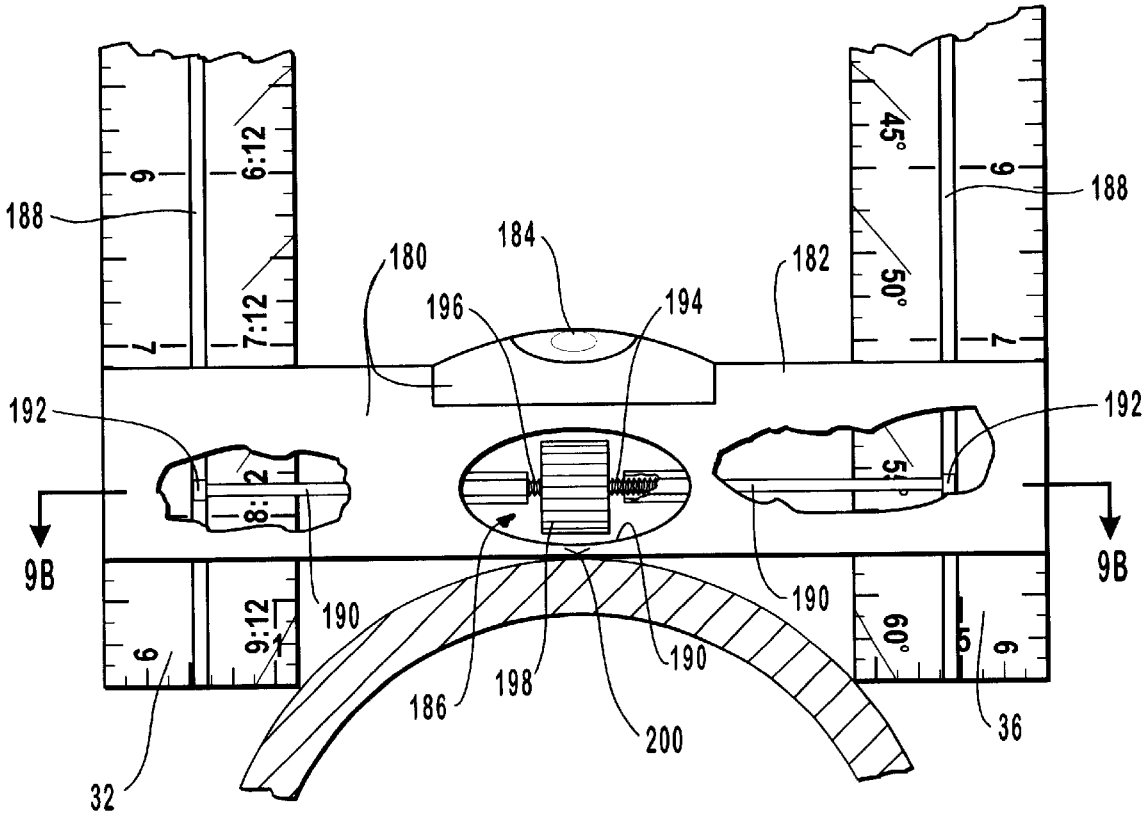
FIG. 9A shows a side view of the level bar of an embodiment of the present invention.
Figure 9B:
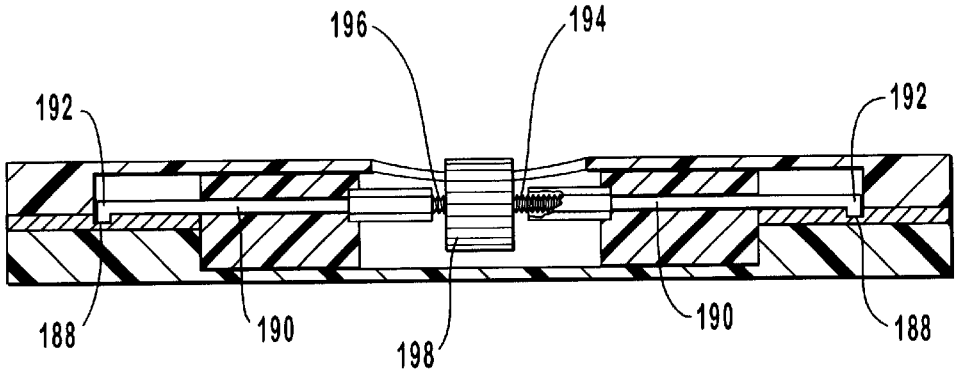
FIG. 9B shows a cross-sectional view of the level bar of an embodiment of the present invention.

Preferred embodiments of the present invention may also comprise a level bar 180, as shown in FIG. 9A, for further functionality. Level bar 180 comprises a cross member 182 which extends between legs 32 & 36 and houses a level 184 to indicate when cross member 182 is horizontal. Preferred embodiments of level bar 180 also comprise a locking mechanism 186 to hold level bar 180 at a specific location in perpendicular alignment with legs 32 & 36.

In a preferred embodiment of locking mechanism 186, grooves 188 are made in legs 32 & 36. Locking rods 190 comprise protruding exterior ends 192 which protrude into grooves 188. The interior ends of rods 190 connect to threaded ends 194 & 196. Threaded ends 194 & 196 are threaded in opposite thread winds such that the threads on one end are a right-hand thread and the threads on the other are a left-hand thread. An adjustment nut or wheel 198 encompasses threaded ends 194 & 196 at their interior ends and engages the threads thereon such that rotating adjustment wheel 198 in one direction will exert an inward force on threaded ends 194 & 196 and rotating in the other direction with exert an outward force on threaded ends 194 & 196. In this manner, rotation of adjustment wheel 198 will cause threaded ends 194 & 196 and rods 190 with their protruding exterior ends 192 to move inward or outward thereby engaging grooves 188 and locking level bar 180 in a specific position.

Level bar 180 may be used as a short leveling device as can be used for many applications known in the trades. Level bar 180 may also be used to set a particular distance on the linear scales of the present invention for laying out multiple identical measurements. An additional use of level bar 180 requires the use of center reference point 200 to find the top of a pipe or other round shape. If legs 32 & 36 are placed substantially vertically over a horizontal pipe, as shown in FIG. 9A, and level bar 180 is placed in contact with the pipe, center point 200 will point to the top of the pipe when level 184 indicates a level condition. This feature can be extremely useful when items must be fitted to the top of a round member.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed is:

1. A construction layout apparatus comprising:

a stepped base member having an upper end member and a lower base plate, said upper end member and said lower base plate parallel to each other and existing in separate planes, said upper end member and said lower base plate coupled together by an offset member substantially perpendicular to said end member and said base plate;

one or more reference surfaces on said base member;

a plurality of legs extending from said base plate in opposite direction from said end member, said legs comprising a plurality of parallel edges perpendicular to said base member, said edges being separated by a distance which corresponds to a commonly used spacing distance for connecting connectors to an I-beam counterpart.

2. The apparatus of claim 1 wherein said legs are substantially planar and wherein at least one of said reference surfaces falls within the geometric plane formed by said legs.

3. The apparatus of claim 1 wherein said legs are substantially planar and wherein at least one of said reference surfaces is offset from and substantially parallel to the geometric plane formed by said legs.

4. The apparatus of claim 1 wherein said distance separating said edges corresponds to a standard spacing distance for bolts used in connecting structural steel members.

5. The apparatus of claim 1 wherein said distance separating said edges corresponds to a standard spacing distance for high-strength steel bolts used for connecting structural steel members.

6. The apparatus of claim 1 wherein said distance separating said edges is 3", 5½" or multiples thereof.

7. The apparatus of claim 1 further comprising an extension plate which extends the length of said legs and said edges.

8. The apparatus of claim 1 further comprising one or more linear measurement scales which designate distances measured from said one or more reference surfaces.

9. The apparatus of claim 1 further comprising one or more angular measurement scales.

10. The apparatus of claim 1 further comprising a level bar.

11. An apparatus comprising:

an elongated base member having an upper end member and a lower base plate, said upper end member and said lower base plate parallel to each other and existing in separate planes, said upper end member and said lower base plate coupled together by an offset member substantially perpendicular to said end member and said base plate;

a plurality of legs protruding in an opposing direction from said end member, said legs integrally formed with said base plate of said base member;

one or more linear reference markings on said base member;

a plurality of linear edges on said legs, said edges being perpendicular to said linear reference markings and separated by a designated distance which corresponds to a standard spacing distance for connecting steel connectors to I-beam counterparts; and a reference edge protruding from said base member, said reference edge being parallel to but offset from the geometric plane formed by the length of said legs.

12. The apparatus of claim 11 further comprising one or more linear measurement scales.

13. The apparatus of claim 11 further comprising one or more angular measurement scales.

14. The apparatus of claim 11 further comprising an extension plate which engages and extends said legs.

15. The apparatus of claim 11 further comprising a cross member with a locking mechanism.

16. An apparatus comprising:

a metal base strip;

two parallel flat legs protruding perpendicularly from said base strip, said legs each having interior linear edges and exterior linear edges, wherein said interior linear edges are separated by a distance which corresponds with a first commonly used spacing distance for connectors of structural steel members, and wherein said exterior linear edges are separated by a distance which corresponds with a second commonly used spacing distance for connectors of structural steel members;

a planar offset member protruding perpendicularly from said base strip, said offset member having an interior surface and an exterior surface wherein said interior surface and said exterior surface are perpendicular to said linear edges;

a planar end member protruding perpendicularly from said planar offset member, said end member having a reference edge, the length of said reference edge being perpendicular to said legs;

one or more linear measurement scales on said end member; and one or more linear measurement scales on said legs.

17. The apparatus of claim 16 wherein said first commonly used spacing distance is 3 inches.

18. The apparatus of claim 16 wherein said second commonly used spacing distance is 5½ inches.

19. The apparatus of claim 16 further comprising an aperture in said offset member to aid in grasping said apparatus.

20. The apparatus of claim 16 further comprising a level bar.

* * * * *